United States Patent [19]

Petsching et al.

[11] 4,448,365

[45] May 15, 1984

[54] FILM DEVELOPING SPOOL

[75] Inventors: Helmut Petsching, Gummersbach; Walter Kremer, Bergneustadt; Rainer Bernhardt, Bergneustadt; Johannes J. Bockemuehl-Simon, Bergneustadt, all of Fed. Rep. of Germany

[73] Assignee: JOBO Labortechnik GmbH & Co. KG., Gummersbach, Fed. Rep. of Germany

[21] Appl. No.: 363,235

[22] Filed: Mar. 29, 1982

[30] Foreign Application Priority Data

Apr. 3, 1981 [DE] Fed. Rep. of Germany ..... 3113465
Nov. 26, 1981 [DE] Fed. Rep. of Germany ..... 3146802

[51] Int. Cl.[3] ..... B65H 75/14; B65H 75/28

[52] U.S. Cl. ..... 242/71.8; 242/74; 242/77.1; 354/341

[58] Field of Search ..... 242/74, 71.8, 77.1, 242/71.9; 354/340, 341

[56] References Cited

U.S. PATENT DOCUMENTS

| | | | |
|---|---|---|---|
| 2,299,981 | 10/1942 | Harlam | 242/77.1 X |
| 2,578,262 | 12/1951 | Paterson | 242/77.1 |
| 2,711,864 | 6/1955 | Windman | 242/77.1 |
| 3,132,818 | 5/1964 | Hansen et al. | 242/77.1 X |
| 3,795,370 | 3/1974 | Dean | 242/77.1 X |
| 3,819,125 | 6/1974 | Bockemuehl-Simon | 242/77.1 |

FOREIGN PATENT DOCUMENTS

| | | |
|---|---|---|
| 884277 | 7/1953 | Fed. Rep. of Germany . |
| 1090518 | 10/1960 | Fed. Rep. of Germany . |
| 1191228 | 4/1965 | Fed. Rep. of Germany . |
| 102304 | 11/1923 | Switzerland . |

*Primary Examiner*—Stuart S. Levy
*Assistant Examiner*—Scott J. Haugland
*Attorney, Agent, or Firm*—Peter K. Kontler

[57] ABSTRACT

A spool for developing (and optionally drying) strip-shaped film material has a core and two axially spaced end flanges provided with many large cut-outs so as to leave only a few narrow, spoke-like portions of material. A pair of inserts is provided which are placed against the outer sides of the respective end flanges and have projecting plug-like portions which enter the respective cut-outs. The inner surface of each of these plug-like portions has a plurality of major fragments of the turns of a spiral groove. The inner surfaces of the spoke-like portions have spot-support portions defining on each spoke-like portion a plurality of minor fragments of the turns of the same spiral groove, so as to complete the groove when the plug-like portions are inserted into the cut-outs. The film strip or strips is (or are) then inserted into the groove to spirally surround the core. Thereafter, the inserts are detached from the spool and can be immediately used to load another spool. This leaves the film material held only by the spot supports so that no shading will occur during development of the film or films.

20 Claims, 12 Drawing Figures

FILM DEVELOPING SPOOL

BACKGROUND OF THE INVENTION

The present invention relates to film spools.

More particularly, the invention relates to film developing spools, i.e. spools for use in the developing of photographic films.

Still more specifically, the invention relates to a novel film developing spool which eliminates developing errors that are inherent in the prior-art spools due to the construction thereof.

Film developing spools of the general type in question are, of course, already known. An example is the one disclosed in German Pat. No. 884,277 which has a core provided with two disk-shaped end flanges. The inwardly facing sides of these end flanges (i.e. the sides which face axially of the core towards one another) are each provided with a continuous spiral groove. The edges of the film strip to be developed are to enter these grooves so that the film is wound up about the core in spiral convolutions which are maintained spaced from one another by a specific distance, which is determined by the radial spacing of the convolutions of the spiral grooves. The two end flanges can be rotated relative to one another about the longitudinal axis of the core (i.e. about the axis of the spiral grooves); this permits insertion of the film strip into the spool by first placing the free end of the strip into the spiral convolutions and then turning the end flanges so that the strip becomes wound up about the core of the spool. A rachets or similar device is provided to aid in this insertion. A cut-out may also be provided (under simultaneous reduction of the guide-rib thickness at the outer sides of the end flanges) through which a user's fingers can gain access to the edges of the film strip being inserted; at the cut-out location the inner film guide ribs forming the spiral groove are then inwardly extended by a certain distance in order to assure that the film strip will still be properly guided in the vicinity of the cut-out location.

Actually, there are two possible ways of installing a film strip to be developed on this prior-art spool. One of these is the insertion "from outside in" as described above. The other is an insertion from "inside out", meaning that the leading end of the film strip is secured to the core (a clamping tongue or similar device may be provided for this purpose) and a device is provided for briefly squeezing the film strip together in transverse direction in order to make it narrow enough to enter the convolutions of the guide spirals.

Once spools of the kind here under discussion are loaded with film strips (and there may, of course, be more than one such strip to be loaded on each spool), one or more of these loaded spools are stacked into a drum which is then rotated and is maintained (usually by a waterbath) at the requisite developing temperature. Due to the rotation of the drum the spirally convoluted film strips on the spools keep dipping into and being pulled through the chemical developer solution; since this results in a rather sparing use of the solution, and hence a cost reduction, spools of the type under discussion are popular. Moreover, such spools admit to another manner of effecting the development of the film, namely stacking the spools in a vertical tank which is then filled with the developer up to the upper spool and thereafter successively reversed through 180° until development is completed.

A serious problem with the prior-art spools of the kind under discussion is that marginal zones of the film strips are usually not properly developed, especially when the rotary-drum type of development is employed. These "developing errors" are quite generally unsatisfactory; they are, however, especially unacceptable when the film negative extends over the entire width of the film strip (as in the case of roll films) so that there is in effect no "margin" and any improper development along the film strip edge is observed as a defect in the actual picture itself. The reason for these developing errors is that the spiral groove guiding the edges of the film strip on the spool tends to "shade" the edge zones; which is to say, it prevents proper access of the developer to the edge zones and thus creates the developing error. It is a reasonable assumption that this problem could be counteracted by reducing the depth of the ribs forming the spiral grooves. Unfortunately, this assumption does not hold true because such a reduction would jeopardize proper insertion and retention of the film strip in the spiral grooves, eliminating the certainty that all film convolutions are held spaced from one another by a specific predetermined distance, irrespective of whether the film is inserted into the spool by the "outside in" or the "inside out" method described before.

Other types of prior-art film developing spools are known from e.g. German Allowed Application AS Nos. 1,090,518 and AS 1,191,228. In these spools the end flanges have the shape of a spoked wheel and the axially inner sides of the spokes are provided with teeth which are intended to capture and hold the margins of the inserted film strips. What is lacking in these constructions is the continuous spiral groove so that there is no positive guidance and support for the film strip during loading of the same. The risk resulting from this is that successive convolutions of the film strip will not enter between the therefor intended teeth on the spokes, so that some teeth may retain no portion of the film strip at all, whereas two or more convolutions of the film strip may be captured in close proximity (or even contact) with one another between a single set of teeth—with the resulting disadvantages during subsequent developing. Furthermore, the missing spiral groove makes it impossible to load a film strip by sliding its leading end between the end flanges and pushing inwardly and, finally, the insertion of the film strip by means of an auxiliary inserting device is unreliable with this type of spool.

OBJECTS AND SUMMARY OF THE INVENTION

It is, accordingly, an object of the present invention to overcome the disadvantages of the prior art.

A more particular object of the invention is to provide an improved film developing spool which is not possessed of the disadvantages of the prior art.

A still more specific object of the invention is to provide a film developing spool which reconciles the inherently contradictory requirements of being able to assure proper insertion (loading) of the film strip into (or onto) the spool while, at the same time, preventing the "developing errors" mentioned before.

A concomitant object of the invention is to provide a film developing spool of the kind under discussion which is highly reliable in its operation and performance.

An ancillary object is to provide such a film developing spool which is relatively uncomplicated and not—or not substantially more—expensive to produce than the prior art spools.

Pursuant to these objects, and still others which will become apparent hereafter, one aspect of the invention resides in the provision of a spool for strip-shaped photographic material, particularly for developing of such material, comprising an elongated core having spaced end portions each carrying a transversely extending end flange, each of the end flanges having an axially inner surface and being provided with a plurality of circumferentially spaced cut-outs over the predominant portion of the surface; a plurality of spot supports projecting from said surface intermediate the cut-outs and defining a minor fraction of the successive turns of a spiral groove surrounding the core, the spot supports being adapted to hold strip-shaped photographic material on the spool in a position spirally surrounding the core; and a plurality of plug portions shaped to enter into the respective cut-outs, each plug shaped portion being formed with turns corresponding to a major fraction of the spiral groove so that the fractions in the inserted plug-shaped portions complete the groove in conjunction with the spot supports, the plug-shaped portions being attachable to the end flanges for loading of the photographic material onto the spool and thereafter detachable prior to developing.

The use of inserts, in conjunction with insert openings provided for them in the respective spool end flange, is preferably such that all inserts for a particular end flange are arranged on a common carrier, naturally in the requisite relative relationship. This carrier is then applied against the (axially) outer side of the respective end flange in order to install it on the spool. The carrier may (but need not) be in form of a plate having sectors provided with the guide ribs, and in between these sectors free areas which are to receive the ribs of the spool end flange. These ribs have what will hereafter be referred to as "spot supports" or "spotlike support areas" which are each flush with the guide ribs of adjacent ones of the sectors. Once inserts have been put in place—which in effect means that they have been pushed into their associated openings—the spool according to the invention has on the axially inner side of each end flange a continuous spiral groove. Moreover, the depth of each groove—and therefore the depth of the ribs defining the respective groove—is great enough to assure complete and proper guidance for the film strip(s) being loaded onto the spool, whether this be done by the "outside-in" method or the "inside-out" method. Once the film strip is loaded onto the spool, however, the inserts according to the invention can then again be withdrawn from their respective openings, since the aforementioned spot supports are completely adequate for retaining the film convolutions at their desired predetermined distance during the developing process. What this amounts to, then, is that during the developing process those film spool portions which in the prior art caused the developing errors, are totally absent in the novel spool so that uniform development of the film (without development error) can proceed over the entire film width. The objectionable defects in the development of the individual negatives are therefore overcome by resort to the present invention.

Since the inserts are not needed during the developing process, it is clear that there is not need for a one-to-one relationship between each spool and the inserts. Instead, one set of inserts may serve two or even a much greater number of spools of like type and size, since the inserts can be used to load other spools while the first-loaded spool (or set of spools) is being subjected to the developing process. For this reason the present invention is highly suited for amateur (do-it-yourself) developers, since the spools themselves (especially the end flanges thereof) are light-weight and lacey or filigree-like (so that they require little material and are correspondingly inexpensive), whereas of the inserts (which require more material and are therefore more expensive) only a single set need be acquired to enable the user to utilize all of these spools.

An incidental benefit of the lacey structure of the spool proper (i.e. without the inserts) is that these spools can be used—subsequent to the developing process—as "drying" spools on which the freshly developed film can remain until the developer solution on it has dried. Any developer droplets remaining entrapped at the spot supports can be quite readily removed by tapping the spool, for example against some abutment. Alternatively, it is possible to add a surfactant to the final film rinsing bath; this will then eliminate the retention of droplets and any associated tapping. In any case, once developing (and rinsing) have been completed, the spool with the developed film thereon can be exposed to air drying or it can be inserted into a conventional drying apparatus. In any case, however, the film will be confined to a small space during drying (since it remains on the spool) and the spool itself does double duty as a drying spool and thus eliminates any need for the purchase of separate drying spools.

It has been indicated before that a spool embodying the invention might be loaded with one or more film strips, evidently depending upon the length of these strips and the capacity of the spool. It is clear that in order to achieve maximum utility from the spool, each spool should be loaded with as much film material as it can hold. To make this possible, one embodiment of the invention proposes—in at least one annular zone—to enlarge the radial distance between adjacent spiral convolutions of the guide ribs which define one of the continuous spiral grooves, in order to obtain a space in which auxiliary ribs may be located which define an auxiliary (and radially offset) spiral groove for the reception of an additional film strip (which may be longer, shorter or the same as the first strip), preferably together with a separate retainer for the leading end of this additional film strip. At its outer border or margin this annular zone may be provided with a port at which the auxiliary spiral groove departs (forks off) from the continuous main spiral groove. In this embodiment it is possible to load two (e.g. short) film strips on the spool and to subject them to simultaneous development. The first-loaded film strip will have its leading end secured to the retainer at or near the core of the spool and it will be held in the convolutions of the continuous main spiral groove. The second film strip will have its leading end connected to the retainer which is provided within the annular zone; it traverses the convolutions of the auxiliary groove and at the port it enters into the radially outer portion of the continuous main spiral. If for some reason it is desired to load the spool with only one film strip, especially should the strip be short, then it is advisable to use the auxiliary groove and the associated retainer to assure that the film strip is located as far outwardly from the core of the spool as possible. The reason for this is that if a spool so loaded is inserted into a rotating developing drum having an inner diameter closely corresponding to the outer diameter of the spool, only a small quantity of developer fluid will be required for proper processing, since the fluid in the drum needs to extend only to the level of the film strip located in the outer annular spool zone.

It should be understood that the spool according to the present invention can, of course, equally well be used to develop long (or longer) film strips. At the aforementioned port (also called "film-diverter" hereinafter) the convolutions of the auxiliary groove are then unused and the film strip extends in the main continuous groove from the outer edge of the end flanges to the center core.

One of the important aspects of the invention, which helps in making the spool according to the invention so well suited for amateur use, is the fact that no special attention or care is required for loading the film strip (even a long one) onto the spool, if the loading is effected by the "inside-out" method mentioned before. Only the main groove is used in this and there is no possibility of interference by the auxiliary groove. Conversely, the film strip can also be loaded onto the spool by the kind of "outside-in" method in which two fingers of a user are employed to advance the film strip stepwise (details will be discussed later) from the periphery of the spool towards the core thereof. Of course, a decision is then to be made—when the leading film end encounters the film diverter—whether to let the film enter the main groove or go into the auxiliary groove. As will be seen in the detailed description, means may be provided for blocking the entrance of either of these grooves when the entrance to the other is open and vice versa.

The film retainers used are advantageously of the type which support the leading end portion of the film strip (in longitudinal direction thereof) over at least a part of its length. Insofar as the auxiliary film retainer is concerned, the one which is associated with the auxiliary groove, it will be appreciated that in normal operation it would have to extend into the space between the two end flanges of the spool and would interfere with the loading of any film strip into that part of the main groove which is located radially inwardly of the earlier-mentioned annular zone. It is therefore of advantage to use an auxiliary film retainer which can be moved from its operative position into an inoperative position, in which latter position it will not interfere in the above-described manner. One such possibility would be to use a separate component which is put in place only when needed; however, this then places upon the user the burden of installing and removing such a component and keeping track of it between applications (there is also the danger of outright loss). A more advantageous solution therefore is the use of an auxiliary film retainer which is mounted so that is cannot be lost, i.e. either on the spool (one or both end flanges) or on one or both of the inserts. To hold the leading end of a film strip firmly in place during the period that counts, the auxiliary film retainer must be of fairly sizeable dimensions. If it is installed on the spool itself, even if it can be retracted to an inoperative position, chances are that it will during developing of the film cause precisely the kind of errors (i.e. it will interfere with unobstructed developing) which the present invention seeks to avoid. It is therefore advisable to mount the auxiliary film developer on one or both of the inserts so that it is removed from the spool when the inserts are removed; this is entirely feasible since, once loaded onto the spools and with the inserts removed, the film strip is held in place by the spot supports and there is no longer any need to hold its leading end portion. The detailed description will show that an auxiliary film retainer of this kind may be in form of a slide (preferably bipartite with each part mounted in a different one of the two inserts to minimize the bulk of each part) which can be moved (mirror-symmetrically, if there are two separate parts) between an operative and an inoperative (withdrawn) position.

As mentioned before, it is possible to provide means for blocking (closing) the radially outer inlet (located at the film diverter) of one of the main and auxiliary grooves while opening (unblocking) the inlet of the other one of the grooves. This is a safety feature to guard against careless or inattentive operation by a user and is, incidentally, a further advantage to the amateur developer. If such means are in fact provided, then it is advantageous—especially for ease of operation—to fixedly connect the blocking means with the auxiliary film retainer so that, when the film retainer is moved between its operative and inoperative positions, the blocking means will (automatically) move with it and unblock one of the groove inlets while blocking the other groove inlet. For example, the arrangement might be such that when the auxiliary film retainer is in its inoperative position the blocking means blocks (at the film diverter) the inlet to the auxiliary groove while unblocking the inlet to the main groove. The blocking means may be in form of cam portions provided on (or of one piece with) the part or parts of the auxiliary film retainer, and which enter into the respective groove inlets in dependence upon the location of the film retainer.

It has already been indicated that it is desirable for the end flanges to be as "tenuous" as possible, i.e. to have as little material (and as many cut-outs) as is possible and consistent with the (very low) structural strength required of them. The reason for this is that the larger the total area of the cut-outs, the larger will be the proportion of the main groove (and of the auxiliary groove, if one is used) which is formed on the inserts and which is removed prior to developing of the film. In other words: this is beneficial to the goal of obtaining improved developing results.

In light of this the spokes or generally spoke-shaped portions of material holding the rim of each end flange, are advantageously made as narrow as possible—e.g. just sufficiently wide to hold the spot supports. On the other hand, all plug portions belonging to a respective end flange should advantageously be arranged on a single insert common to them all (arranged according to the size and location of the cut-outs on the end flange, so that they can be easily inserted). As the detailed description will show, an advantageous further embodiment of the invention suggests to so construct the inserts that, when applied to the end flanges, they form a stable almost frame-like structure in which the spool is held between the inserts. There is no great complexity involved, since it is sufficient to provide the first insert with an axial shaft, pin or portion which, in the operative position of this insert, is passed through a center passage of the (in this case, at least) hollow core and which is long enough so that its distal end portion projects outwardly beyond the remote end of the passage. The second insert is then pushed onto this projecting end portion and releasably locked in place by screw threads, a snap-type latch or in fact any other suitable detents known from the prior art.

The novel features which are considered to be characteristic of the invention are set forth in particular in the appended claims. The improved device itself, however, both as to its construction and its mode of operation, as well as additional features and advantages thereof, will be best understood upon a perusal of the following detailed description of certain specific although purely exemplary embodiments with reference to the accompanying drawing.

DESCRIPTION OF PREFERRED EMBODIMENTS

Figure 1:
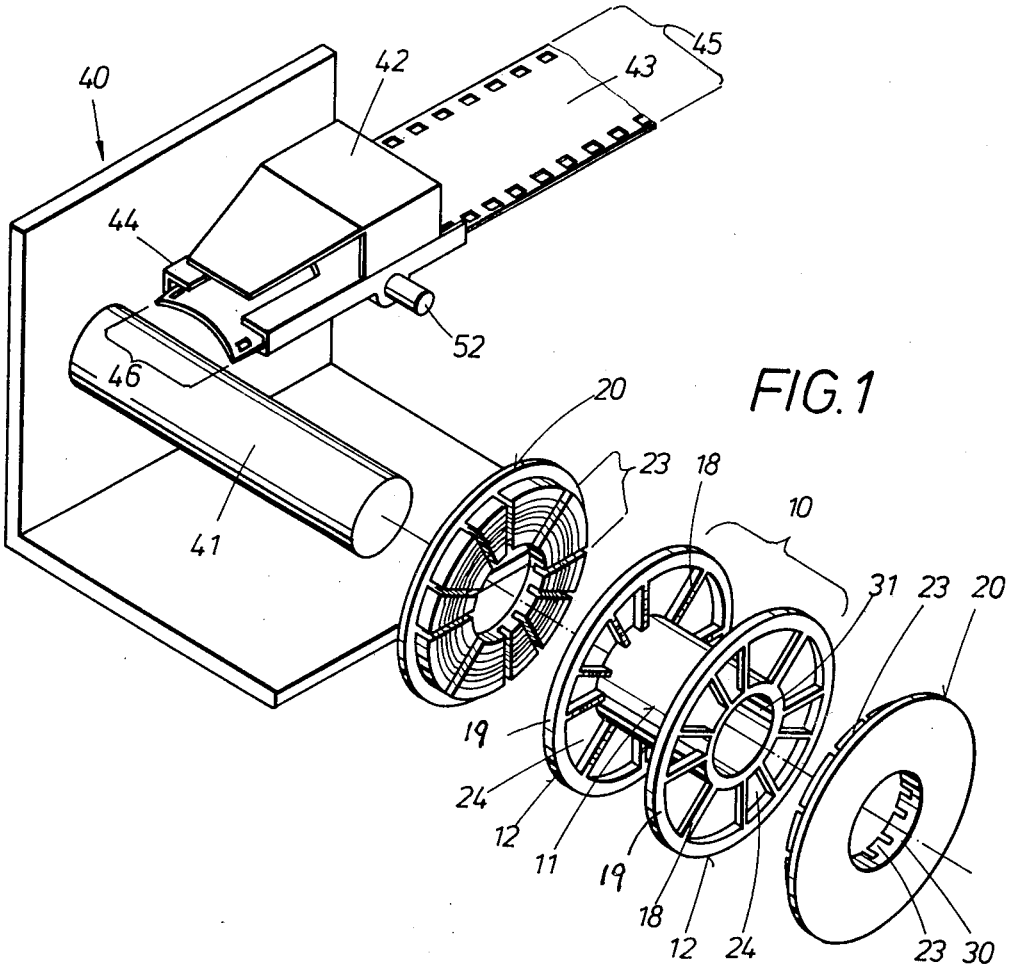
FIG. 1 is an exploded perspective view of a spool embodying one form of the invention in conjunction with a device for winding film strips onto the spool.

A first embodiment of the invention is illustrated in FIGS. 1–6 which should be considered in conjunction with one another.

The spool in this embodiment is composed of two component parts, namely the actual film developing spool 10 having an axially elongated core 11 which is provided at or near its ends with a pair of axially spaced end flanges 12, and a pair of engageable and disengageable inserts 20 which will subsequently be described in more detail.

The core 11 of the actual spool 10 here is composed of two telescoped-together sleeves 13, 14. These can be telescoped together or apart to a defined, predetermined extent in order to space the end flanges 12 from one another by a specified distance 15 (FIG. 2) whose magnitude depends upon the transverse width of a film strip (or film strips) to be loaded onto the spool (and hence to be accommodated between the end flanges 12). The two sleeves 13, 14 can also be turned about their joint longitudinal axis to a predetermined extent, in order to permit a concomitant turning of the end flanges relative to each other. The reason for this turning movement (which could be omitted if not desired) is that it permits the push-in loading (the "outside-in" method describe earlier) of film strips onto the spool. The spool and inserts are provided for this purpose with a "gripping zone" 25 for this purpose; the specific details and use of this zone will be discussed later, in conjunction with FIG. 4. To permit the desired axial telescoping and angular displacement of the sleeves 13, 14 relative to one another, and to allow them to be arrested in the respective selected positions, facing surfaces of the sleeve 13, 14 are provided with axial grooves 16, abutments 17 and also (not illustrated) circumferential grooves. Such grooves and abutments are known per se from the prior-art film developing spools and are not novel in themselves.

It is typical for the invention that the end flanges 12 of the spool 10 are of filigree-like construction; which is to say that they contain only little solid material and are provided with holes or openings 24 over by far the greatest part of their respective surface areas. In the embodiment of FIGS. 1–6, each end flange 12 in effect resembles a spoked wheel having only a relatively few spokes or webs 18 which extend more or less radially, as shown (compare FIGS. 1 and 3). These spokes 18 extend outwardly from the core or hub 11 directly, or from a ring (not shown) which is of one part with (or fixedly connected to) the core 11 (or, more specifically, the respective sleeve 13 or 14). The radially outer ends of the spokes 18 are connected and held in their relative predetermined positions by an outer ring 19 which again may be of one piece with them or be a separate ring that is fixedly connected to the spokes.

The spool 10 as just described is that part of the novel film developing spool which actually holds the film strip(s) to be developed. However, during loading of the film strip onto this spool, use is made of the previously mentioned two detachable inserts 20, 20 which in this particular embodiment are of identical construction.

Figure 2:
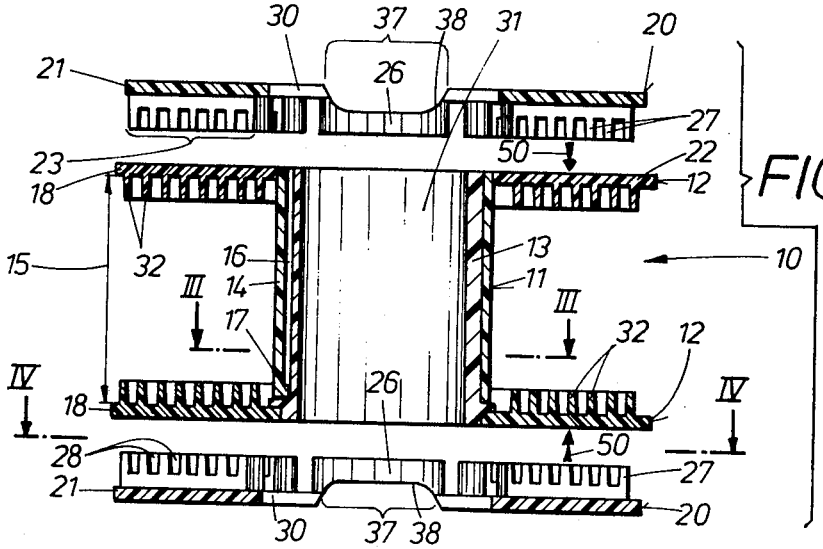
FIG. 2 is an axial sectional view of the spool of FIG. 1, with separable parts shown in disengaged positions, the section being taken in the direction of arrows as seen from the line II in FIG. 3 or 4.
Figure 3:
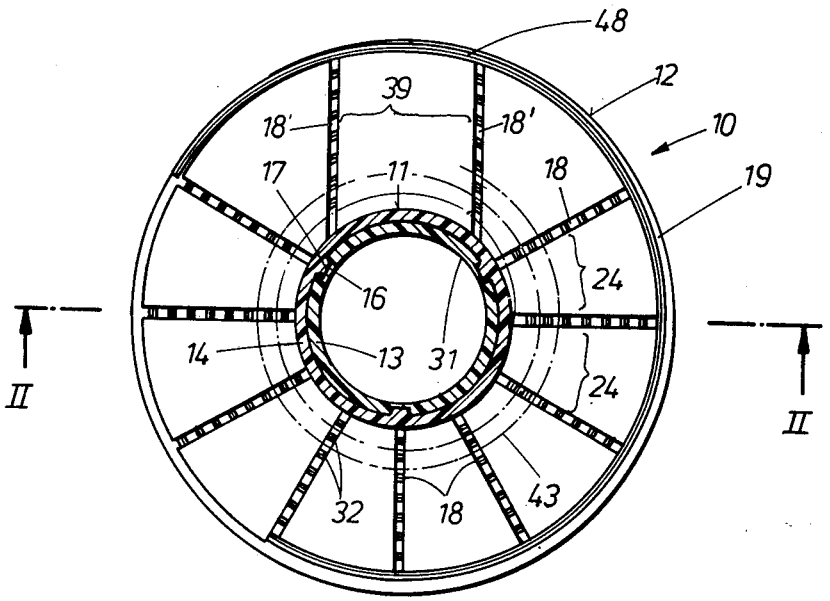
FIG. 3 is a radial sectional view of the spool of FIG. 2, taken in the direction of arrows as seen from the line III—III of FIG. 2.
Figure 4:
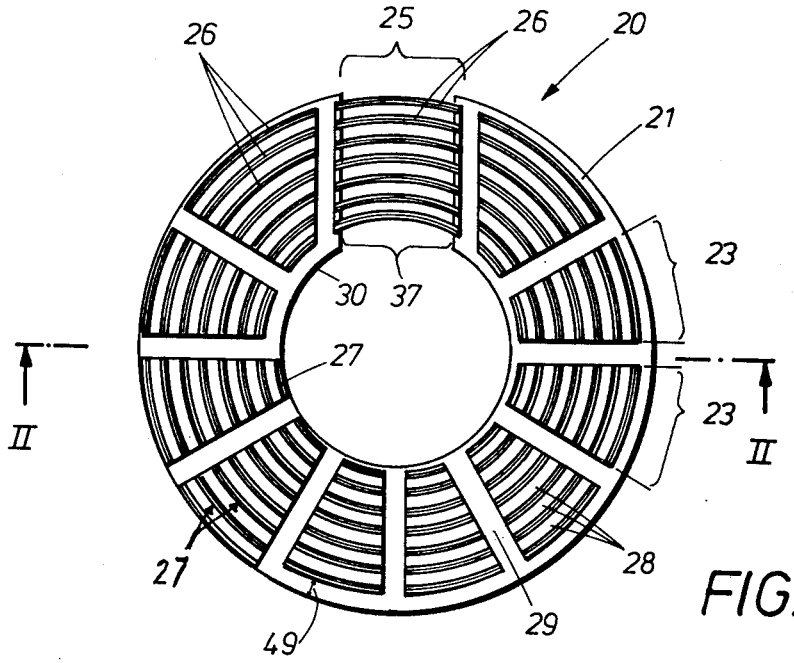
FIG. 4 is an end elevational view of the spool of FIG. 2 as seen in the direction of arrows from the line IV—IV shown in FIG. 2.

As perhaps best shown in FIG. 2, each of these inserts 20 is composed of a plate member 21 which, when the insert is assembled with the spool 10 (see arrow 50), abuts the axially outer end face 22 of one of the end flanges 12. Each plate 21 has on its own axially inner end face (i.e. the one which will abut the respective outer end face 22) a series of circumferentially spaced sector-shaped areas 23 which are so dimensioned that each of them fits precisely and smoothly into one of the openings 24 which are left in the respective end flange 12 between the spokes 18 thereof. FIG. 2 shows that the areas 23 are provided with portions (to be discussed shortly) which project axially from the respective plate member 21, so that each area 23 enters an associated opening 24 in the manner of a plug.

From FIG. 4 it is evident again that the areas 23, just like the spokes 18 with the exception of the previously mentioned gripping zone, are radially oriented and that they are shaped as sectors of a circle. The areas 23 are provided or formed with a spiral rib 27 composed of a plurality of turns 26; it is this rib which constitutes the axially projecting portions mentioned in the preceding paragraph and which enter into the respective openings 24 of the end flanges 12. Rib 27 forms in each area 23 (radially) successive partial convolutions of a spiral groove 28 adapted to receive a film strip 43 (shown in FIG. 1). Between the circumferentially succesive areas 23 the plate 21 is formed with web portions 29 which are free of the rib 27 and into which the spokes 18 of the respective end flange 12 fit, when the inserts 20 are assembled with the spool 10. The plate 21 of each insert 20 is provided with a central hole 30; when the plate is installed on the spool 10, this hole 30 becomes aligned with the outlet opening 31 of the axial passage formed by the telescoped sleeves 13, 14 (see FIG. 3).

Figure 5:
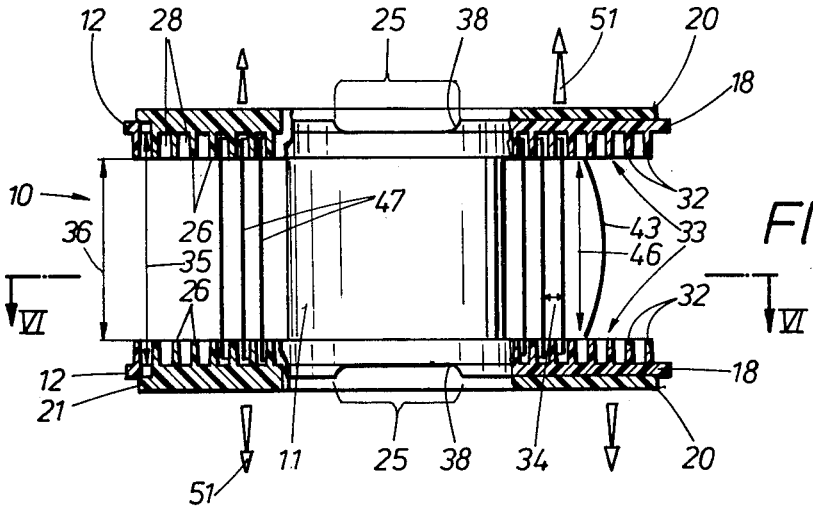
FIG. 5 is an axial sectional view of the spool which is shown in FIG. 2, with all separable parts in assembled condition and the section taken in the direction of arrows as seen from the line V—V of FIG. 6.
Figure 6:
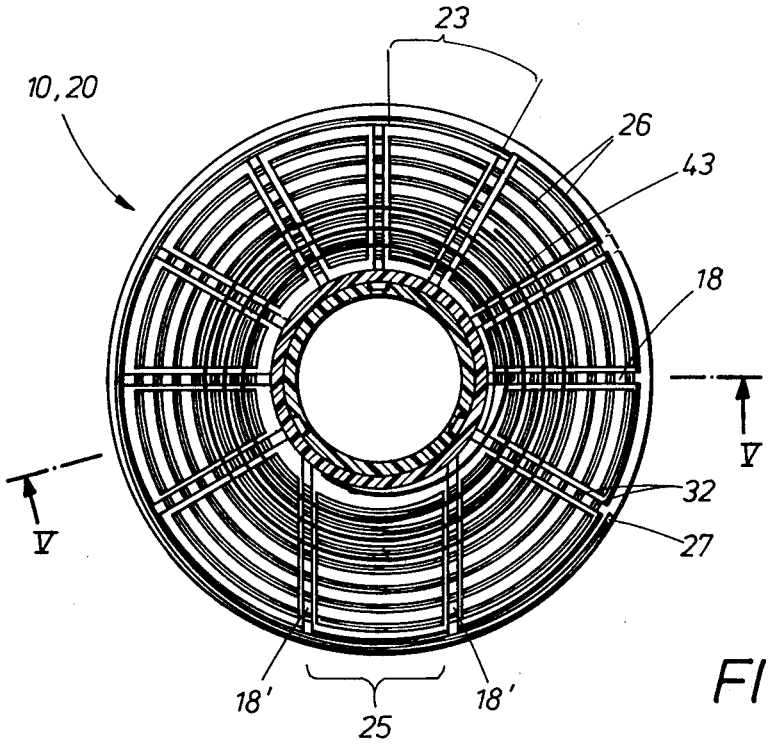
FIG. 6 is a sectional view as seen in the direction of arrows from the line VI—VI of FIG. 5.
Figure 7:
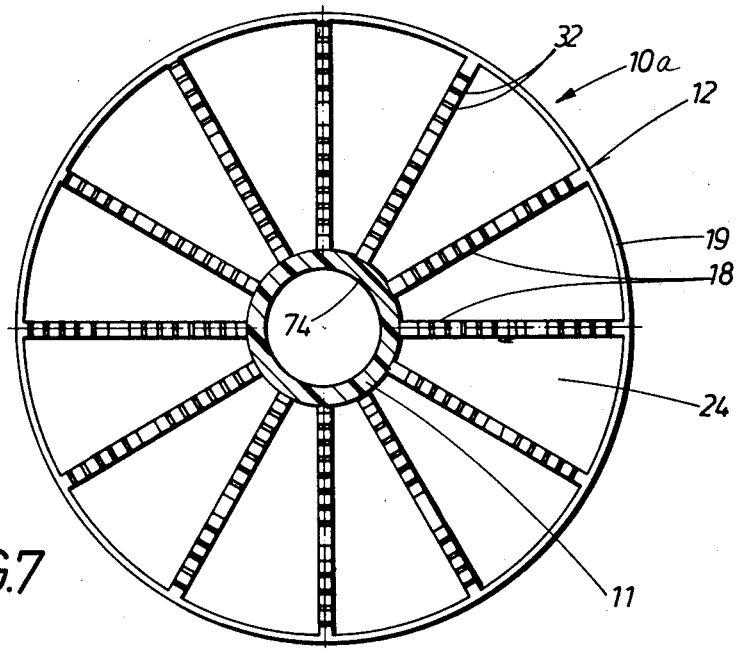
FIG. 7 is a cross-sectional view of the core of a spool which embodies another form of the invention, also showing the axially inner surface of one of the end flanges of the spool.

The spool 10 and the inserts 20, 20 are shown in assembled condition in FIGS. 5 and 6. It will be seen, especially from FIGS. 2 and 5, that the axially inner sides of the spokes 18 of end flanges 12 are provided with exactly positioned and oriented spot supports 32 which, when the inserts 20 are installed on the respective end flanges 12, are aligned with the turns 26 of the rib 27 formed on the respective areas 23. In this embodiment these spot supports 32 are arranged in the semblance of a comb (cf. FIGS. 2 and 5). When the areas 23 are inserted into the openings 24, the axially innermost end faces of the spot supports 32 and of the turns 26 of the rib are located at least generally in a common plane transverse to the axis of the core 11. Together they thus define continuous spiral grooves 28, of which one each is located in the respective end flange 12. These two grooves 28 are now ready to receive the marginal portions of a film strip being loaded onto the spool 10.

Loading of the film strip 43 onto the spool 10 of FIGS. 1–6 can be effected in two different ways, one of which is shown in and will be discussed with reference to FIG. 1.

As shown in FIG. 1, a film loading device 40 is provided, having a pin or bolt 41 onto which the spool 10 is slipped once the inserts 20 have been installed on the end flanges 12. The thus assembled spool (i.e. components 10 and 20) can be rotated directly or indirectly on the pin 41. The device 40 also has a film loading jig 42 which is tiltable about a pivot 52 so that it can be moved to whatever inclined position is required for proper loading of the film strip 43 onto the spool.

The jig 42 is, in effect, a guide for the incoming film strip 43 whose original transverse width is indicated at 45 in FIG. 1. In order to fit between the end flanges 12 during the initial insertion, and then fit into the convolutions of the spiral groove 28, this original film width must be temporarily reduced to a lesser width 46. For this purpose the outlet end of the jig 42 is provided with a track 44 which squeezes the margins of the film strip 43 together in transverse direction until the reduced width 46 is reached. As a result of such squeezing the film strip becomes transversely bowed, as illustrated; however, this is only temporary. The reduced width 46 is less than (or at most equal to) the maximum distance 36 between the innermost end faces of the spot supports 32 and turns 26 of the rib 27; this permits easy insertion of the leading end of the film strip 43 between the end flanges 12 and securing of the leading end to the core 11 (film retaining instrumentalities for this purpose are known per se and therefore here not illustrated). Once the leading end of the film strip is secured to the core 11, the spool is rotated on the pin 41, causing the film strip 43 to be pulled out of the jig 42 and to enter the successive convolutions of the spiral grooves 28. It should be noted that fairly shortly after leaving the width-reducing track 44 of jig 42 the inherent flexibility of the film strip will cause the same to re-assume its original width 45; at this time the film strip is already located opposite the convolutions of the spiral grooves 28 so that during the transverse width increase (or rather return to the original transverse width) the film strip margins can comfortably enter into the convolutions of the grooves 28 (see in this connection also FIG. 5 which shows some convolutions 47 of the film strip 43 installed on the spool whereas the (at the moment) radially outermost convolution of the film strip 43 still has the bowed configuration in which it left the jig 42). It will be understood that the radial spacing 34 between the radially successive film-strip convolutions 47 is determined by the radial spacing of the turns 26 of rib 27 which forms the spiral groove 28.

The alternative method of loading the film strip onto the spool 10 does not require the use of the device 40 shown in FIG. 1. Instead, it uses a push-in technique which does, however, require the presence of the earlier briefly mentioned gripping zone 25. This gripping zone requires a somewhat special configuration for the inserts 20, in that each plate 21 is provided in the respective zone 25 with a cut-out 37 (see in FIGS. 2 and 4). The turns 26 of rib 27 are nevertheless provided despite the cut-outs 37; however, to permit this, the axially outer side of the respective plate is provided with a depression 38 (cf. FIG. 2) which is deep enough for the tip of an inserted finger to engage the edge of the film strip 43 when the inserts are installed in the position shown in FIG. 5. In the region of each cut-out the respective end flanges 12 are also provided with a corresponding opening 39 so as to assure free access of the finger tips to the film strip edges; this is shown most clearly in FIG. 3. To further reduce any possibility of interference with the user's fingers during the film loading operation the two spokes 18' bounding the respective opening 39 do not extend radially, as is the case with the upper spokes 18, but instead expend parallel to one another. This assures that a space of uniform width remains between them which extends from the outer ring 19 to the core 11.

It is advantageous if the outer ring 19 itself is formed with a partial turn 48 of the rib 27 which latter is otherwise strictly confined to the respective insert 20 (except where it is augmented in forming the groove 28 by the spot supports 32 of the spokes 18, 18'). The reason for this preferable construction is that—to assure maximum space utilization of the spool diameter—the rib 27 is carried radially outwardly until it reaches the outer ring 19. This means, however, that the last (radially outermost) partial turn 48 cannot be provided anymore on the plate 21 where an empty strip portion 49 remains (see FIG. 4). In other words, the film-strip holding capacity of this portion 49 is lost, unless it can be compensated by locating the partial turn 48 on the outer ring 19 itself.

When the spool has been assembled in the manner shown in FIG. 5 and is to be loaded by the alternative method, the leading end of the film strip 43 is pushed into the radially outer end opening of the groove 28 which is defined between the partial turn 48 and the circumferentially successive turn 26 of rib 27. The user's fingers, which are inserted into the two depressions 38 and through the same into the cut-outs 37, now engage and retain the inserted leading end of the film strip 43. Now one sleeve 13 with its associated end flange 12 and insert 20 is turned relative to the other sleeve 14 with the end flange 12 and insert 20 associated therewith, to the extent permitted by the cooperating detent portions on the sleeves 13, 14. This operation is then repeated for the other sleeve 14 with its end flange 12 and insert 20, and such relative displacement is alternated. In a corresponding cadence the user inserts and withdraws his two fingers from the depressions 38, i.e. engages and disengages the edges of the film strip 43. The result of this technique is that during each turning movement one of the two fingers holds and advances the film strip deeper into the groove 28 (i.e. towards the core 11) whereas the other finger engages and retains the film strip in its farther inserted position during the reverse rotation of the respective sleeve and its associated end flange and insert. The end result is a step-wise transportation of the film strip from the radially outer circumference of the spool 10 towards the core 11.

A very important aspect of the invention is that the inserts 20 are not needed—and in fact not desired to be present—once the film strip 43 has been loaded onto the spool 10. For this reason the inserts 20 are removed after the film strip is completely loaded (by whatever technique the user chooses to employ), by pulling them off the respective end flange 12 in the direction indicated by the arrows 51 in FIG. 5. This is possible because the loaded film strip 43 will now be held firmly and with its convolutions at the requisite spacing, by the spot supports 32 on the spokes 18, 18' (see FIG. 6). What remains after removal of the inserts 20 is the spool 10 (having core 11 and end flanges 12) with the spirally wound film strip 43 loaded thereon. This composite is very "airy", which is to say that all of its parts offer extremely easy access to any surrounding fluid. Since all portions of the rib 27 are removed when the inserts 20 are detached, and since the film strip remains held only by the small spot supports 32 on the very few spokes 18, 18', it stands to reason that the "shading" of the film strip edges against proper contact with the developing fluid (caused in the prior art by the presence of the equivalents of rib 27) is eliminated in the present invention. Thus, in the spool according to the invention the film strip 43 can be properly developed over its entire width and picture defects due to the aforementioned "shading" are avoided. In fact, once developing of the film strip is completed, the strip can remain on the spool and be air-dried or power-dried, thus avoiding at least one operating step (moving the developed strip from the developing spool onto a drying spool) and eliminating the need for purchasing separate drying spools in the first place, a consideration which is of particular interest to the amateur developer.

Moreover, and this is equally important to the do-it-yourself amateur, only a single set of inserts 20 is required to successively load any desired number of identical spools 10. Once a spool has been loaded with its film strip and the inserts 20 have been detached, the inserts can be immediately used to load a film strip onto another spool, while the previously loaded spool with its film strip undergoes developing (and possibly also drying) of the film strip. The inserts 20 might be considered to be parts of a film loading device which are needed only and exclusively for loading film strip onto a respective spool 10. Such loading may be carried out mechanically (as in FIG. 1) or manually, as desired, since the ribs 27 have an adequate film guiding depth between the successive turns 26 of the rib. The need to purchase the set of two inserts 20 only once to load any desired number of spools 10 will be of interest to the amateur developer, because the spools 10 themselves require very little material and can therefore be sold at relatively small cost, whereas the inserts 20 (which require more material and will therefore be correspondingly more expensive) need be purchased only once as a set of two and can then service as many spools 10 as the user desires.

The inserts 20 with all their parts 21–30 may be made of any of various materials. However, it has been found most advantageous to make them of one piece from a suitable synthetic plastic material (e.g. polyethylene, polyurethane, polystyrene); a method that lends itself well to such manufacture is injection molding.

A second embodiment is illustrated in FIGS. 7–12. Since the spool **10*a* and the inserts 20*a* basically are almost the same as in FIGS. 1–6**, a repetition of the previously given description is not needed here, and the description will instead be concentrated on the existing differences.

To install a strip film on the spool **10*a*, the inserts 20*a* are needed again, just as in the case of the inserts 20 in the preceeding Figures. The inserts 20*a* are, for this purpose, placed against the outer axial sides of the end flanges 12 (not visible in FIG. 7, but compare FIGS. 11 and 12). One of the two inserts 20*a* of the set is shown in sectional view in FIG. 8, prior to its installation on respective end flange 12**.

Figure 11:
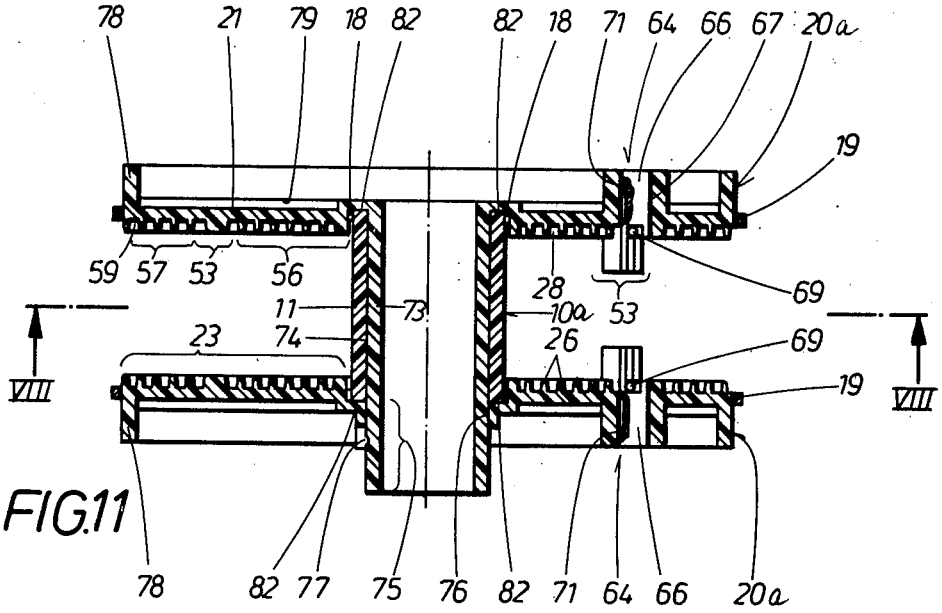
FIG. 11 is an axial sectional view as seen in the direction of arrows from the line XI—XI in FIG. 9, showing the spool in assembled condition but with the film strip omitted for clarity.
Figure 12:
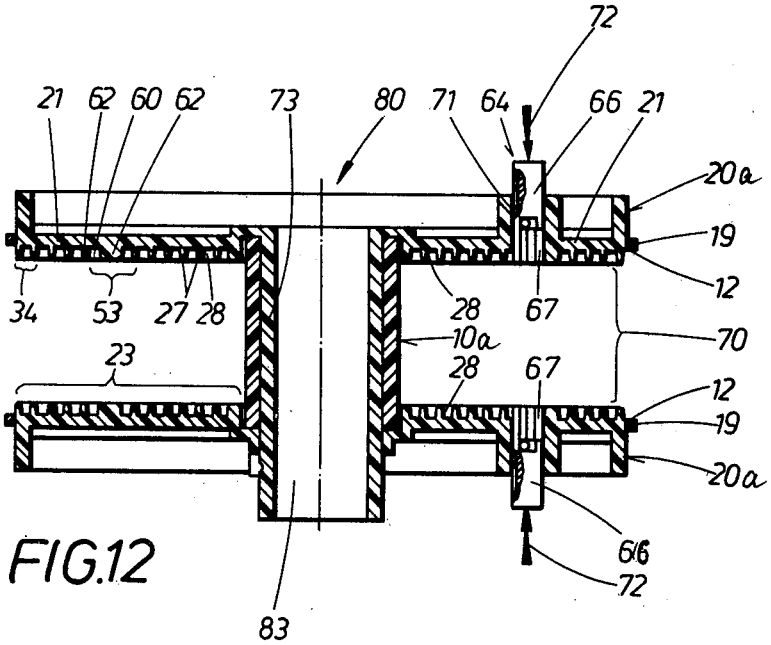
FIG. 12 is an axial sectional view as seen in the direction of arrows from the line XII—XII of FIG. 10, again showing the spool in assembled condition but with the film strips omitted for the sake of clarity.

The two inserts **20*a* differ from one another, in that one of them is formed with a tubular shaft or extension 73 which, when this insert is installed on the spool 10*a*, is inserted through an axial passage 74 formed in the spool core 11 (see FIG. 11) and thereafter projects with its free end portion 75 beyond the opposite axial side of the spool 10*a*. The other insert 20*a*, having a central opening 76 (FIG. 11) is then pushed onto this projecting end portion 75 and becomes releasably engaged with a detent 77. In all other respects the two inserts 20*a* are identical in that each is composed of a flat plate 21 (see FIGS. 8 and 11) having recessed radial grooves 79 which, when the inserts are installed on the respective end flanges 12, receive the spokes 18 so that, in the final installed position, the inner surfaces of the spokes 18 are flush with the non-recessed sectors 81 of the plate 21. This is to say that when the inserts 20*a* are installed on the end flanges 12, the bottom surfaces bounding the radial grooves 79 abut the axially outer sides of the end flanges 12 whereas the sector-shaped areas 81 of the respective inserts 20*a* are received in and fill the openings 24 of the end flanges 12, forming specially profiled plugs 23 on the inner surfaces of the end flanges 12. When the inserts 20*a* are installed on the spool 10*a* they form therewith, as best seen in FIGS. 11 and 12, a sort of frame or cage 80 which is quite strong and reinforces the spool 10*a* that is located between them. The two inserts 20*a* also each have central contact faces which are abutted by the axial ends of the spool core 11**, on installation of the inserts on the spool.

Figure 8:
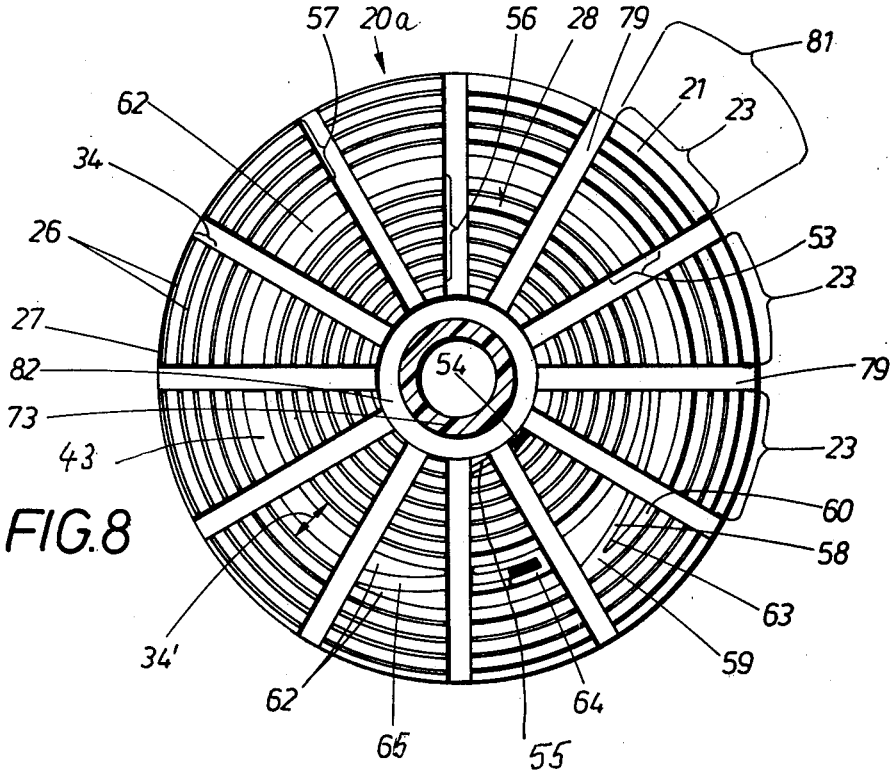
FIG. 8 is a cross-sectional view of the assembled spool of FIG. 7, the section being taken in the direction of arrows as seen from the line VIII—VIII of FIG. 11.

As before, the spiral ribs 27 on the respective inserts **20*a* form on the inner surfaces of the plates 21 (and the spot supports 32 form with them on the inner surfaces of the spokes 18) the respective spiral grooves 28; since in this embodiment a second groove is involved the spiral grooves 28 will hereinafter be called the "main" spiral grooves and their shape is best exemplified by the long film strip 43 which is shown inserted on the spool 10*a* in the illustration of FIGS. 8 and 9. A first film retainer 54 (known per se) is provided in the vicinity of the core 11, for engaging and retaining the leading end of the film strip 43**.

Approximately in the radial center of the axially inner surface of the composite inner axial end faces formed by the spokes 18 and plugs 23 of the insert 20*a*, each of these surfaces is provided with an annular zone 53. FIG. 8 shows that in these zones the otherwise uniform radial distance 34 between adjacent spiral turns of the respective rib 27 is enlarged in the respective zone 53 to a greater spacing 34'. As shown again in FIG. 8 each zone 53 subdivides the continuous main spiral groove 28 into an inner portion located in the radially inner region 56 of the respective composite inner axial end face, and an outer portion located in the radially outer region 57 of the same axial end face. The two thus separated parts of the main groove 28 are continuously connected by a channel 58 which extends through the respective annular zone 53. As before, only spot supports 32 (cf. FIG. 7) remain as the boundaries of the main groove 28 (i.e. for the development and possibly drying phase) when the inserts 20*a* are removed after loading of the film strip onto the spool and before the developing process begins.

As mentioned before, this embodiment has a second groove. This is the auxiliary groove 60 (FIG. 9) whose turns or convolutions 61 are formed by auxiliary ribs 62 and are located in the respective annular zone, radially offset relative to the spool core 11. In the illustrated embodiment the auxiliary grooves 60 each have only a single turn or convolution, permitting the annular zones 53 to be relatively narrow in radial direction (see the spacing 34'). The outer border of each annular zone is provided with a diverter 63 (best shown in FIG. 8) where the auxiliary groove 60 and the channel 58 coming from the inner portion 56 of the groove 28 merge with one another and then again merge in the outer region 57 into the radially outer portion 59 of the main groove 28. A second film retainer 64 is provided at the beginning of the auxiliary spiral groove 60, so as to hold the leading end of a second film strip 65 (cf. FIG. 10).

To permit selective loading of the spool 10*a* with one or two film strips, the film retainer 64 is of two parts (see FIGS. 11 and 12) each of which is composed of a slide 66 that is movable in a guide 67 of the respective plate 21. Each slide carries a spiral spring 69 or the like which serves to clamp the leading end 68 of film strip 65 (FIG. 10).

Figure 9:
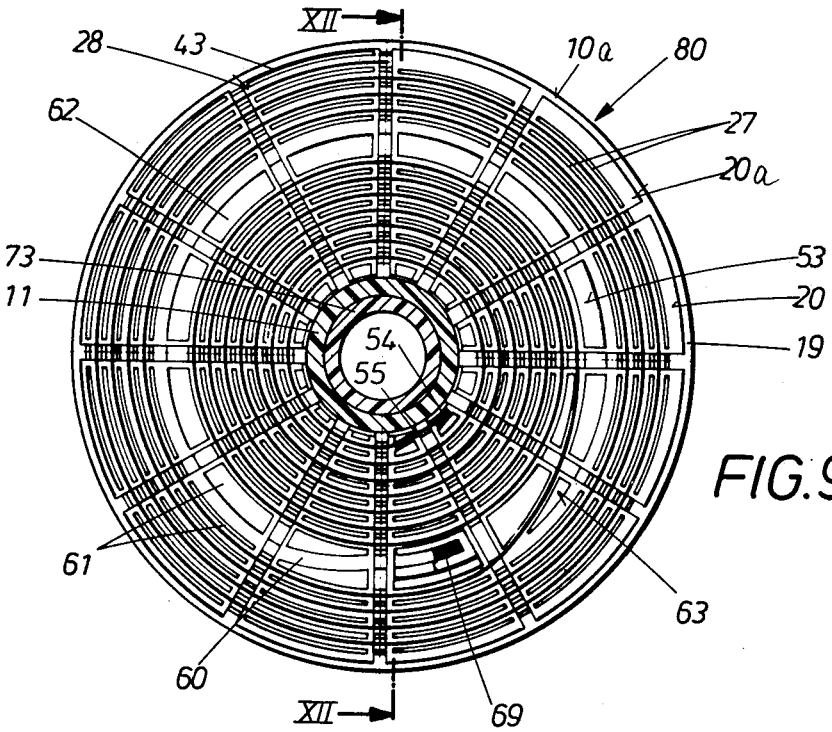
FIG. 9 is a cross-section view similar to that of FIG. 8 but showing the spool with a relatively long film strip loaded on it.

As a joint consideration of FIGS. 9–12 shows, the spool 10*a* can indeed be selectively used with one or two film strips. To load the long film strip 43 onto the spool, beginning from the core 11, the two slides 66 are first moved to the retracted positions shown in FIG. 12 so that the space 70 between the main grooves 28 is unobstructed. The slides 66 are then retained in these positions by abutments and/or detents 71 acting between the slides 66 and their guides 67. Now the long film strip 43 can be loaded onto spool 10*a*, starting from the core and working outwardly towards the outer circumference of the spool, by rotating the "frame" 80 manually or via a suitable (known per se) instrumentality. For example, the spool 10*a* can be slipped with its axial passage 83 onto the pin 41 of the device 40 illustrated in FIG. 1 and the spool then be rotated, with the result which is shown in FIG. 9. In this operation the auxiliary groove 60 remains unused since in the area of the respective annular zone the film strip 43 is smoothly led through the aforementioned channel 58 and automatically enters the outer portion 59 of the main groove in the region of the diverter 63.

Figure 10:
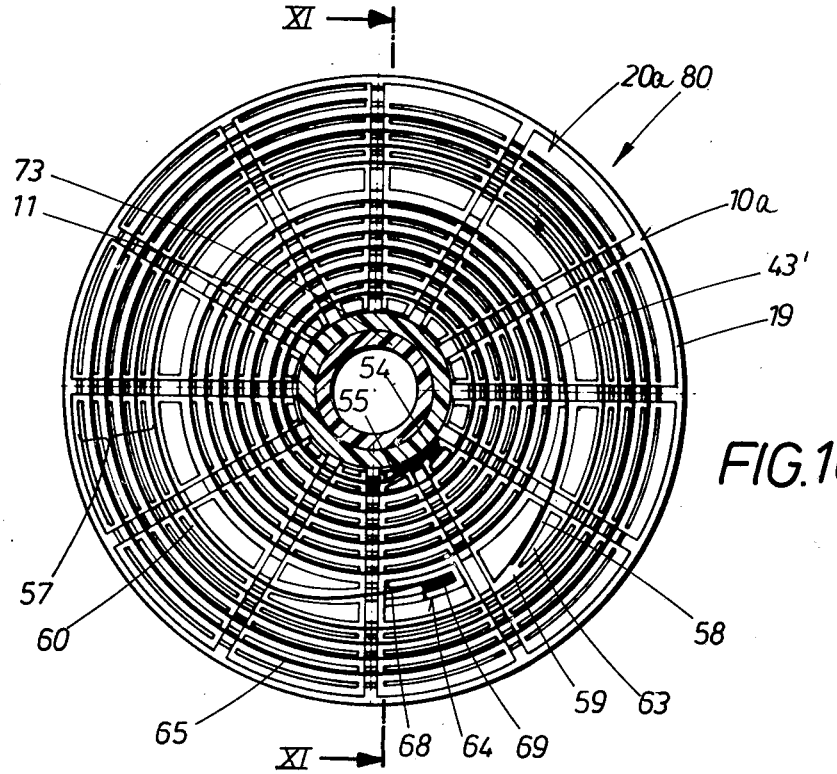
FIG. 10 is a view similar that of FIG. 9 but showing the spool with two relatively short film strips loaded onto it.

The alternative use of the spool 10*a* is shown in FIG. 10. Here, a short film strip 43' is first loaded onto the spool 10*a*, again beginning from the core 11 and working outwardly. The operation is the same as described with reference to FIG. 9, and of course the leading end of film strip 43' is first secured to the film retainer 54. At this time the two slides of the second film retainer are in the inoperative positions of FIG. 12. The film strip 43' is short enough not to extend beyond the channel 58 in the region of the respective annular zone 53.

When loading of the film strip 43' is completed, the slides 66 of the film retainer 64 are then pushed inwardly (see the arrows 72 in FIG. 12) until they assume the operative positions shown in FIG. 11; in such positions, they are retained by the detent elements 71 and extend into the space 70. They are now ready to hold the leading end 68 of the second short film strip 65. This latter strip is now also installed, for example by means of the device 40 shown in FIG. 1. As FIG. 10 shows, the strip 65 first travels through the auxiliary groove 60 and, on reaching the diverter 63, automatically enters the outer portion 59 of the main groove 28 through which it then extends within the radially outer part 57 to the necessary extent.

After film has been loaded onto the spool 10*a* either in accordance with FIG. 9 or with FIG. 10, the "frame" 80 is separated from the spool by detaching the inserts 20*a* from the end flanges 12. The film strip (or strips) will now be held only by the spot supports 32 at the desired radial distances and the spool with its single or double film strip is ready for the developing treatment. An incidental advantage of this embodiment is that both film retainers 54 and 64 are parts of the inserts 20*a* and are therefore removed with them (see FIG. 8); this means that they, also, cannot contribute to developing errors and hence have no adverse influence on the quality of the pictures being developed.

The invention is, of course, not bound to the structural details of the illustrated embodiments; rather, these details have been shown only for the purpose of explanation and in accordance with the requirements of law. Evidently, it will be possible in a variety of instances to depart from the illustrated structural details without thereby in any way departing from the concept of the invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and indeed are intended to be comprehended within the meaning and range of equivalence of the appended claims.

We claim:

1. A spool for strip-shaped photographic material, particularly for developing and/or drying of such material, comprising an elongated core having spaced end portions each including a transversely extending end flange, each of said end flanges having an axially inner surface provided with a plurality of circumferentially spaced cut-outs; a plurality of spot supports projecting from each of said surfaces intermediate the respective cut-outs and defining first portions of successive turns of a spiral groove surrounding said core, said spot supports being arranged to hold strip-shaped photographic material on said spool in a position spirally surrounding said core; and a plurality of plug portions shaped to enter the respective cut-outs, each such plug portion having partial turns constituting second portions of the turns of said spiral groove so that the partial turns of the inserted plug portions substantially complete the groove in conjunction with the spot supports, said plug portions being attachable to said end flanges for loading of the photographic material onto the spool and thereafter detachable prior to treatment of the loaded photographic material.

2. A spool as defined in claim 1, wherein the axially inner surface of each of said end flanges has narrow spoke-shaped portions flanked by the cut-outs of the respective end flange, said spot supports being provided on the spoke-shaped portions of the respective axially inner surfaces.

3. A spool as defined in claim 1, wherein each of said end flanges has an axially outer surface and the plug portions for the cut-outs of said end flanges constitute parts of two inserts which are adjacent to the axially outer surfaces of the respective end flanges when the plug portions are introduced into the cut-outs of the respective end flanges so that a set of two of said inserts can serve a plurality of spools in that the inserts cooperate with a particular spool only during loading of photographic material thereonto and are then withdrawn prior to treatment of photographic material, with the loaded photographic material being held only by said spot supports of the particular spool.

4. A spool as defined in claim 1, wherein said end flanges are alternately turnable to and fro relative to one another about the axis of said core and each end flange has a radial opening dimensioned to permit insertion of a finger of a user from the axially outer side of the end flange into engagement with a marginal portion of a strip of photographic material which is being loaded onto the spool.

5. A spool as defined in claim 4, wherein each of said end flanges has an axially outer surface and the plug portions for the cut-outs of said end flanges constitute parts of two inserts each of which is adjacent to the axially outer surface of the respective end flange when the plug portions are introduced into the cut-outs of the respective end flanges, each of said inserts having a film-engaging aperture located in one of the respective plug portions and aligned with the opening of the respective end flange when the plug portions are received in the cut-outs of the respective end flanges.

6. A spool as defined in claim 1, wherein said core has a passage with a first and a second end and each of said end flanges has an axially outer surface, the plug portions for the cut-outs of said end flanges constituting parts of two discrete inserts which are adjacent to the axially outer surfaces of the respective end flanges when the plug portions are introduced into the cut-outs of the respective end flanges, one of said inserts having an axial shaft insertable into one end of the passage in said core and including an end portion projecting beyond the other end of said passage upon complete insertion of said shaft, the other of said inserts having an opening in which said end portion is fittingly receivable and further comprising means for releasably connecting said other insert with said end portion.

7. A spool as defined in claim 6, wherein said inserts together form a frame which surrounds the spool and is rotatable with but not relative to the same, so as to serve as a rotary drive for the spool.

8. A spool as defined in claim 1, wherein each of said axially inner surfaces has narrow strip-shaped portions bounded by the cut-outs of the respective end flange.

9. A spool as defined in claim 2, wherein each of said end flanges has an axially outer surface and the plug portions for the cut-outs of said end flanges constitute parts of two discrete inserts each having an axially inner face arranged to be placed against the axially outer surface of the associated end flange.

10. A spool as defined in claim 9, wherein each of said inserts further comprises a plate provided with the respective plug portions, adjacent ones of said plug portions defining between themselves recesses for entry of said strip-shaped portions so that the axially inner ends of said spot supports and of said partial turns are at least substantially flush with one another when said plug portions are inserted into the respective cut-outs.

11. A spool as defined in claim 1, wherein the portions of said axially inner surfaces intermediate said cut-outs, together with the respective inserted plug portions, form two composite surfaces having the complete spiral grooves thereon, the majority of turns of each of said grooves having a predetermined radial spacing and each of said composite surfaces having at least one annular zone in which the radial distance between the neighboring turns of the respective groove exceeds said predetermined spacing to thus form an intermediate zone, each of said composite surfaces further comprising at least one turn of a rib defining an auxiliary spiral groove which is radially offset relative to said core and is arranged to receive another strip of photographic material, each of said annular zones having a radially outer margin provided with a diverter of photographic material at which the respective auxiliary groove merges into the corresponding first-mentioned spiral groove.

12. A spool as defined in claim 11, further comprising a first retainer in the region of said core for holding a leading end of one strip of photographic material loaded onto said spool, and a second retainer proximal to said annular zones for holding a leading end of the other strip of photographic material.

13. A spool as defined in claim 12, wherein said second film retainer is movable between an inoperative position and an operative position in which latter position it extends into the space between said end flanges.

14. A spool as defined in claim 12 wherein said second retainer is movable between an operative position in which it extends into the space between said end flanges and an inoperative position in which it is withdrawn from said space.

15. A spool as defined in claim 14, further comprising detent means for releasably holding said second retainer in at least one of said positions.

16. A spool as defined in claim 1, wherein said end flanges have axially outer surfaces and said plug portions constitute parts of two inserts adapted to be placed against the axially outer surfaces of the respective end flanges, said second retainer being mounted on one of said inserts.

17. A spool as defined in claim 16, wherein said second retainer is permanently connected to the respective insert and is detachable therewith from the respective end flange prior to treatment of the strip of photographic material.

18. A spool as defined in claim 16, wherein said one insert has a guide and said second retainer includes at least one slide which is movable in said guide between an operative and an inoperative position.

19. A spool as defined in claim 16, wherein each of said inserts has a guide and said second retainer includes two mirror-symmetrical parts each movable in one of said guides towards and away from the other part between an operative and an inoperative position.

20. A method of processing strip-shaped photographic material, comprising the steps of providing a spool composed of a core and narrow-spoked first and second end flanges having axially inner sides provided with spot supports which together define first portions of two spiral grooves surrounding the core and axially outer sides, the spokes of such end flanges being separated by cut-outs; providing first and second inserts each having a surface arranged to be placed against the axially outer side of the respective end flange and provided with a plurality of plug portions each dimensioned to fit into one of the respective cut-outs and formed with fragmentary turns together constituting a second portion of the respective groove and, in conjunction with the corresponding spot supports, completing the respective spiral groove; inserting the plug portions into the cut-outs of the respective end flanges; introducing the marginal portions of at least one strip of photographic material into the completed grooves at the axially inner sides of the two end flanges; thereafter detaching the inserts from the respective end flanges and thereby withdrawing the plug portions from the corresponding cut-outs, leaving the introduced strip of photographic material held in position exclusively by the spot supports of the two end flanges; and subjecting the strip of photographic material on the spool to requisite processing.

* * * * *